US010420972B2

(12) United States Patent
Aguilar et al.

(10) Patent No.: US 10,420,972 B2
(45) Date of Patent: Sep. 24, 2019

(54) DUMMY HEAD FOR SPRINKLER SYSTEMS

(71) Applicants: Ramon Aguilar, Springfield, VA (US); Alejandro Arroyave, Woodbridge, VA (US)

(72) Inventors: Ramon Aguilar, Springfield, VA (US); Alejandro Arroyave, Woodbridge, VA (US)

( * ) Notice: Subject to any disclaimer, the term of this patent is extended or adjusted under 35 U.S.C. 154(b) by 11 days.

(21) Appl. No.: 15/619,666

(22) Filed: Jun. 12, 2017

(65) Prior Publication Data

US 2018/0353788 A1 Dec. 13, 2018

(51) Int. Cl.

| | |
|---|---|
| ***A62C 35/68*** | (2006.01) |
| ***A62C 99/00*** | (2010.01) |
| *A62C 31/28* | (2006.01) |

(52) U.S. Cl.

CPC ..... *A62C 99/009* (2013.01); *A62C 35/68* (2013.01); *A62C 31/28* (2013.01)

(58) Field of Classification Search

CPC ..... A62C 31/28; A62C 99/009; A62C 35/68; A62C 35/00–68; F16L 55/1108; F16L 55/1125; F16L 55/1141; F16L 15/08; F16L 55/10; F16L 55/115; F16L 55/1152; F16L 55/128

USPC ..... 239/37; 138/89, 90

See application file for complete search history.

(56) References Cited

U.S. PATENT DOCUMENTS

| | | | | |
|---|---|---|---|---|
| 1,408,944 | A | 3/1922 | Howard | |
| 2,962,185 | A | 11/1960 | Starr et al. | |
| 5,123,305 | A | 6/1992 | Williams | |
| 6,116,285 | A * | 9/2000 | Wilson | F16L 55/1108 138/89 |
| 6,250,337 | B1 | 6/2001 | Bevacco | |
| 6,484,331 | B2 * | 11/2002 | Minnick | E03C 1/24 285/3 |
| 6,557,825 | B2 | 5/2003 | Stone et al. | |
| 7,276,715 | B2 | 10/2007 | Climent et al. | |
| 7,427,181 | B2 | 9/2008 | Denton et al. | |
| 7,607,456 | B1 * | 10/2009 | Schulz | F16L 55/1141 138/89 |
| 7,624,813 | B2 | 12/2009 | Ma | |
| 8,186,921 | B2 | 5/2012 | Lowman | |
| 8,434,595 | B2 | 5/2013 | Choi | |
| 8,857,729 | B2 | 10/2014 | Nourian | |
| 2010/0319196 | A1 | 12/2010 | Rosenberg | |

FOREIGN PATENT DOCUMENTS

| | | |
|---|---|---|
| JP | 2013-94674 A | 5/2013 |

* cited by examiner

*Primary Examiner* — Arthur O. Hall
*Assistant Examiner* — Juan C Barrera
(74) *Attorney, Agent, or Firm* — Ernesto Garcia

(57) ABSTRACT

A dummy head temporality replaces a sprinkler head in a sprinkler system. The dummy head provides for accurate alignment and sizing of a hole in a drywall and in relation to a sprinkler conduit in the sprinkler system. The dummy head is used to prevent breaking an actual sprinkler head while construction workers do an installation of a ceiling to be painted or covered by drywall joint compound of mud, which saves in service fees and redoing the location of the drywall hole for the inner ring to be placed in the drywall hole.

20 Claims, 2 Drawing Sheets

DUMMY HEAD FOR SPRINKLER SYSTEMS

TECHNICAL FIELD

The dummy head pertains to replacing temporally a sprinkler head in a sprinkler system while construction workers finish up putting up drywall, prepare the drywall with compound and later paint. Once the drywall is placed and prepped, the dummy head is replaced with an actual fire sprinkler head.

BACKGROUND OF THE INVENTION

In the past, a fast solution is to utilize a metal threaded plug or nipple cap to block the exit pipe in a sprinkler system. That only seals the exit pipe while workers work around the sprinkler system. Ma, U.S. Pat. No. 7,624,813, shows the use of this metal plug and a hole in a drywall having a metal ring. This however introduces inaccurate placement and dimensioning of the hole relative to the sprinkler system that sometimes workers have to redo the hole and reinstall drywall. Also, when painters come around, the painters paint over the metal ring which bonds the metal ring to the drywall thus not making it aesthetically to the eye.

SUMMARY OF THE INVENTION

The present invention is a dummy head for a fire sprinkler system that is used temporary while construction workers work in setting up a ceiling or drywall around the sprinkler system. The dummy head is to be made of plastic and has beneficial features that assist sprinkler installer to get exact dimensions and measurements for pipe and final sprinkler head installation, and assist an installer to locate the drywall and the hole of the drywall in the proper location relative to the exit port in the sprinkler system. The dummy head is used instead of the actual sprinkler head during construction so that construction workers do not interfere with the actual sprinkler head breaking it or painting over it.

The present invention provides a construction worker with guidance in making the right size hole for the sprinkler head as well as locating the exit port of the sprinkler system relative to drywall. The dummy head has two diametrical legends at a bottom surface of a flange that indicates the right size hole needed for a sprinkler head assembly. In addition to the two diametrical legends, the flange is sized to indicate how far the dummy head should be inserted in the hole or away from the hole, which determines the right location of the sprinkler head relative to hole in drywall for final wall or ceiling. Two other diametrical legends are marked on the dummy head opposite to each other on the side of the dummy head. A circumferential groove in the flange represents the mid-point between the indicator arrows (max, min), which allows installer to measure and cut the right length of a pipe plus the length of the dummy head to obtain best installation relative to hole in drywall in a finished ceiling or wall.

The present invention provides for tightening the dummy head using two distinct features. The first feature allows an installer to use manual tightening while the second feature allows for tightening using a tool such a ratchet. The dummy head is also provided with a pipe plug opening that allows a steel pipe plug to frictionally fit inside the opening, which both allows the pipe plug to be fastened to the exit conduit of the sprinkler head and become a unitary assembly with the dummy head.

The present invention provides for a filing feature so when the dummy head and pipe plug are removed from the exit port of the sprinkler system, the filing feature scrapes and files any mud left around the hole of the drywall or scrape the hole of the drywall to make the hole bigger if the hole edge is undersized.

In CPVC systems the Dummy Head avoids CPVC cement (glue) from getting into the actual sprinkler head, which can cause water obstruction once head is activated, therefore causing system failure. It can also be used for hydro testing purposes so that actual sprinkler head is not under high pressure stress.

DETAILED DESCRIPTION

Figure 1:
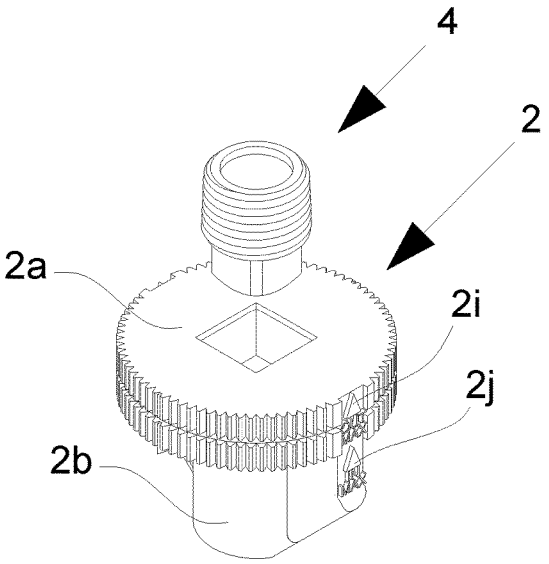
FIG. 1 shows an isometric view of the dummy head along with a steel pipe plug.
Figure 2:
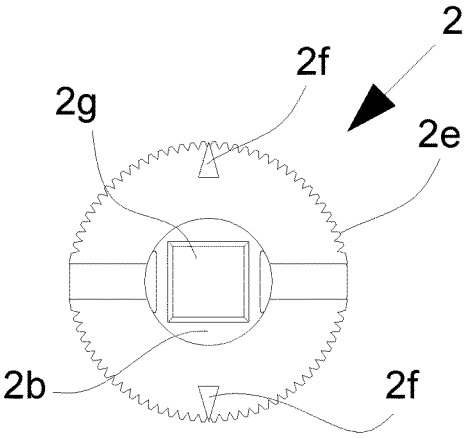
FIG. 2 shows a bottom view of the dummy head shown in FIG. 1.
Figure 3:
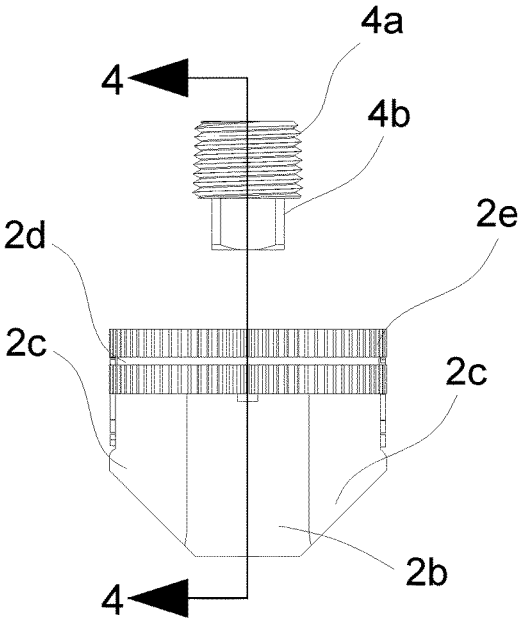
FIG. 3 shows a front view of the dummy head and steel pipe plug shown in FIG. 1.

FIG. 1 shows an assembly comprising a dummy head 2 and a steel pipe plug 4. The dummy head 2 comprises a cylindrical flange 2*a* and a body 2*b* extending from the flange 2*b*. As seen in FIG. 2, the body 2*b* includes a socket opening 2*g* centered on the main body 2*b*. This socket opening 2*g* allows for a driver to be inserted. The flange 2*a* is cylindrical and a circumferential face of the flange 2*a* is comprised of filing serrations 2*e* in the form of sharp teeth, which its purpose will be later defined. Two markings 2*f* in the shape of an arrow are present at the bottom of the flange 2*a* to determine the maximum size a hole in drywall should be. Extending laterally and in opposite directions to each other are two wings 2*c* as seen in FIG. 3. These wings 2*c* are for manual turning of the dummy head 2 and the steel pipe plug 4. The wings 2*c* extend from the body 2*b* and the cylindrical flange 2*a* and disrupt the filing serrations 2*e*. The wings 2*c* include two markings 2*i*, 2*j*. The two markings 2*i*, 2*j* each comprise an arrow and a distinct marking, which respectively indicate the top of the flange and the bottom of the flange. The two markings 2*i*, 2*j* serve as guide to determine how far the dummy head 2 is located relative to hole 14*a* in a drywall 14 of a finished wall or ceiling. The markings 2*i*, 2*j* provide the maximum the dummy head is out or in of the drywall 14 as seen in FIGS. 7 and 8.

Figure 4:
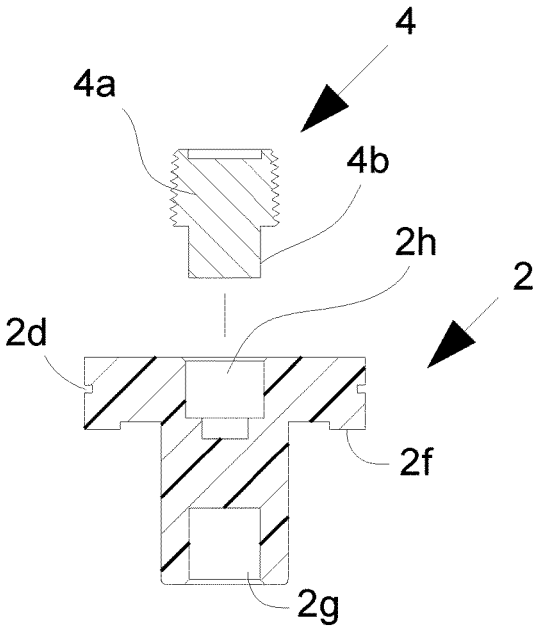
FIG. 4 shows cross-sectional view 4-4 shown in FIG. 3.
Figure 6:
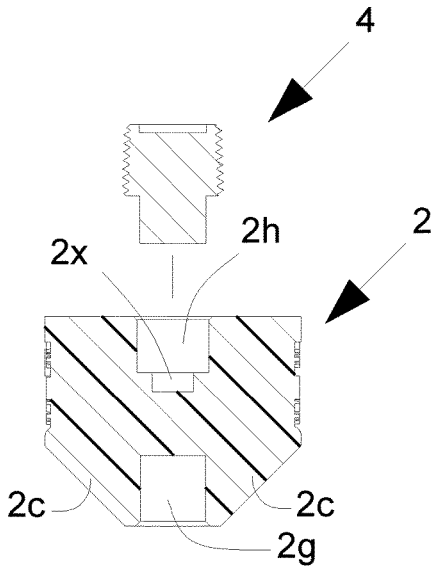
FIG. 6 shows cross-sectional view 6-6 shown in FIG. 5.

As seen in FIGS. 1, 3, and 4, the steel pipe plug 4 comprises a square driving projection 4*b* at one end and a thread 4*a* at another end. The driving projection 4*b* frictionally fits in a corresponding driver opening 2*h*. While it is envisioned that the driver opening 2*h* is rectangular or square, the driver opening can have any other known driver shape. Further, while the pipe plug 4 has been shown to be frictionally fitted, it is envisioned that the pipe plug 4 can be fastened therein in to driver opening 2*h* in any matter such as by gluing or be magnetically connected such as by putting a magnet in an adjacent bore 2*x* as seen in FIG. 6.

Figure 5:
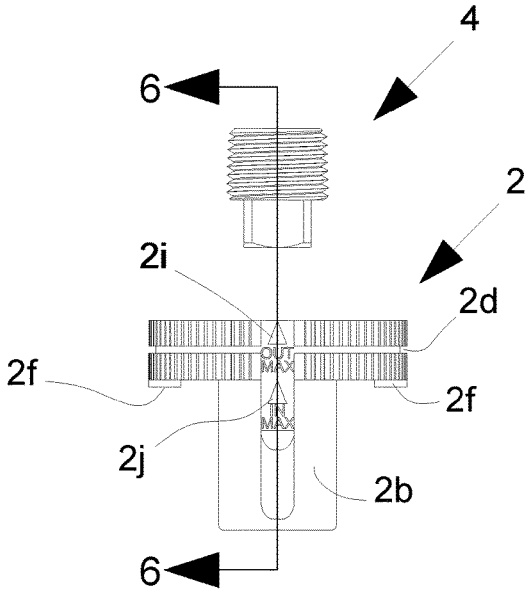
FIG. 5 shows a side view of the combination of the dummy head and steel pipe plug.

FIGS. 3-5 further show a circumferential groove 2*d* also disrupting the filing serrations 2*e* in the flange 2*a*. It is envisioned that the groove 2*d* be centered in the flange 2*a*. The groove 2*d* is a mark that represents the best location of the dummy head relative to the hole in the drywall in a finished wall or ceiling. The groove 2*d* is used by the installer to determine (by measurement) the right length of pipe and length of the dummy head in order to obtain the best location relative to hole in drywall in a finished wall or ceiling. The serrations 2*e* are of the type that can file material off. In the sample provided, the serrations 2*e* have sharp edges that extend parallel to the longitudinal axis of the dummy head. Of course, the serrations 2*e* can be envisioned to have a different pattern like a criss-cross pattern or slanted pattern.

Figure 7:
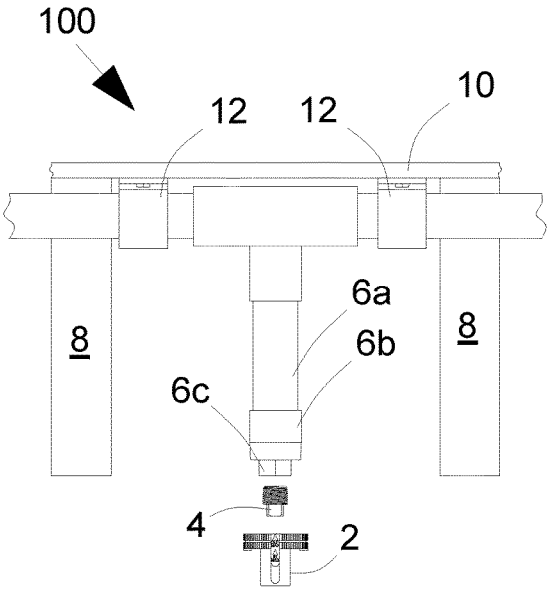
FIG. 7 shows a front view of a sprinkler system utilizing the combination of the dummy head and pipe plug shown in FIG. 1.
Figure 8:
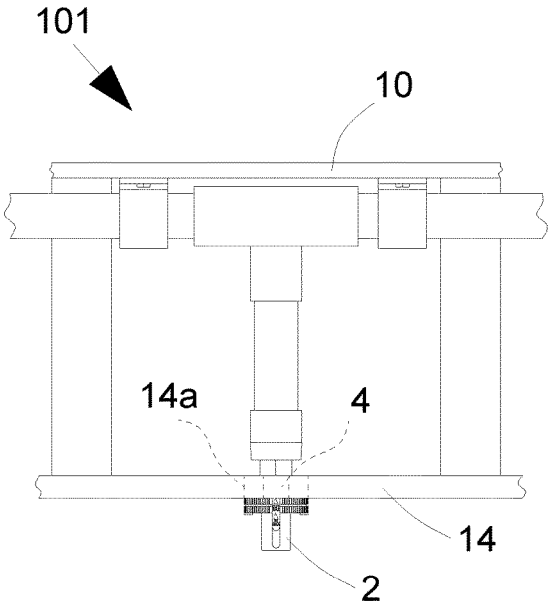
FIG. 8 shows a front view of the sprinkler system shown in FIG. 7 after installation of drywall.

FIG. 7 shows a sprinkler system 100 comprising several trusts 8 and a support wall 10 where several conduits including an exit port 6*a* are suspended and held using clamps 12. The exit port 6*a* includes a bonded bridge 6*b* where a metal threaded port 6*c* is fastened inside the bridge 6*b*. As customary, the threaded port 6*c* is internally threaded where the metal pipe plug 4 is to close the exit port 6*a*.

FIG. 8 shows a sprinkler system 101 utilizing the dummy head 2 and pipe plug 4 adjacent an installed dry wall 14. The drywall 14 includes a sprinkler head opening 14*a* close in size of the flange 2*a*. The plug 4 is threaded to the metal threaded port 6*c*. On inspection, one can see that the dummy head 2 is properly sticking out at the maximum marking 2*i* indicating a maximum allowed proper installation of the drywall 14. This gives the best installation location for the dummy head 2, which is established by the circumferential groove 2*d* which is a mark giving the mid-point between maximum and minimum limits allow for installation. If for some reason mud is placed around the edge of the hole 14*a*, the filing serrations 2*e* will scrape off or file off the mud upon removal of the dummy head. This will insure proper installation of an actual sprinkler head. Further, an added benefit will be that an actual sprinkler head will not be damaged as construction workers continue to prep the drywall for painting or other necessary preparations around a construction site.

It is envisioned that the dummy head 2 while shown being made of plastic can also be made from metal. While the pipe plug 4 has been shown to be separated from the dummy head 2, it is envisioned that one can simply make the pipe plug 4 homogenously integral with the dummy head 2.

The invention claimed is:

1. A dummy head comprising a cylindrical flange and a body extending from the cylindrical flange; wherein the body comprises a socket opening; wherein the cylindrical flange comprising a circumferential surface with filing serrations; wherein the filing serrations scrape and file around a hole of a dry wall; wherein the cylindrical flange further comprising a top surface; and, an external thread extending from the top surface and extending opposite the socket opening.

2. The dummy head of claim 1, further comprising a pair of wings extending from the body and the cylindrical flange disrupting the filing serrations.

3. The dummy head of claim 2, wherein the wings include two markings respectively indicating the top of the flange and the bottom of the flange as a guide to determine drywall thickness for maximum and minimum installation limits.

4. The dummy head of claim 2, wherein the flange further comprising a bottom surface with two diametrical markings to indicate a dimensional guide for a hole in drywall.

5. The dummy head of claim 2, wherein the flange further including a circumferential groove disrupting the filing serrations.

6. The dummy head of claim 3, wherein the two markings include each an arrow and a distinct wording.

7. The dummy head of claim 3, wherein the flange further including a circumferential groove disrupting the filing serrations.

8. The dummy head of claim 6, wherein the top surface of the flange comprises a driver opening to receive a pipe plug having a driving projection corresponding in shape to the driver opening and further having the external thread.

9. The dummy head of claim 8, wherein the pipe plug comprising metal and the dummy head comprising plastic.

10. The dummy head of claim 1, wherein the flange further including a circumferential groove disrupting the filing serrations for indicating a mid point between maximum and minimum installation limits.

11. The dummy head of claim 1, wherein the socket opening being rectangular or square.

12. A dummy head comprising a cylindrical flange and a body extending from the cylindrical flange; wherein the body comprises a socket opening; wherein the cylindrical flange comprising a circumferential surface with filing serrations; wherein the filing serrations scrape and file around a hole of a dry wall; wherein the cylindrical flange further comprising a top surface; and, wherein the top surface of the flange comprising a driver opening.

13. The dummy head of claim 12, further comprising a pipe plug frictionally inserted into the driver opening;

wherein the pipe plug comprising a driving projection corresponding in shape to the driver opening and an external thread.

14. The dummy head of claim 12, further comprising a pair of wings extending from the body and the cylindrical flange disrupting the filing serrations.

15. The dummy head of claim 14, wherein the wings include two markings respectively indicating the top of the flange and the bottom of the flange as a guide to determine drywall thickness for maximum and minimum installation limits.

16. The dummy head of claim 15, wherein the two markings include each an arrow and a distinct wording.

17. The dummy head of claim 16, wherein the flange further comprising a bottom surface with two diametrical markings to indicate a dimensional guide for a hole in drywall.

18. The dummy head of claim 17, wherein the flange further including a circumferential groove disrupting the filing serrations.

19. The dummy head of claim 12, wherein the socket opening being rectangular or square.

20. A dummy head comprising a cylindrical flange having a top surface and a bottom surface, and a body extending from the bottom surface; wherein the body comprising a socket opening having a non-circular shape; wherein the cylindrical flange comprising a circumferential surface with filing serrations between the top surface and the bottom surface; wherein the filing serrations scrape and file around a hole of a dry wall; and, wherein an external thread extending from the top surface and extending axially opposite the socket opening.

* * * * *